US010218118B2

(12) United States Patent
Mito et al.

(10) Patent No.: US 10,218,118 B2
(45) Date of Patent: Feb. 26, 2019

(54) CONNECTOR AND CONNECTOR ASSEMBLY HAVING ELASTICALLY DEFORMED SPRINGS

(71) Applicants: Tyco Electronics Japan G.K., Kanagawa (JP); Toyota Jidosha Kabushiki Kaisha, Aichi-ken (JP)

(72) Inventors: Yusuke Mito, Kanagawa (JP); Hiroshi Kobayashi, Aichi-ken (JP)

(73) Assignees: Tyco Electronics Japan G.K., Kanagawa (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 15/615,921

(22) Filed: Jun. 7, 2017

(65) Prior Publication Data

US 2017/0352983 A1 Dec. 7, 2017

(30) Foreign Application Priority Data

Jun. 7, 2016 (JP) ..... 2016-113546

(51) Int. Cl.
*H01R 13/627* (2006.01)
*H01R 13/629* (2006.01)
(Continued)

(52) U.S. Cl.
CPC ..... *H01R 13/62977* (2013.01); *H01R 13/26* (2013.01); *H01R 13/6272* (2013.01);
(Continued)

(58) Field of Classification Search
CPC .... H01R 13/533; H01R 33/975; H01R 4/032; H01R 33/7664; H01R 13/62933; H01R 13/62938
(Continued)

(56) References Cited

U.S. PATENT DOCUMENTS 3,394,337 A 7/1968 Miller
3,609,637 A * 9/1971 Cole ..... H01R 13/627 439/349
(Continued)

FOREIGN PATENT DOCUMENTS

CN 101199087 A 6/2008
CN 101517842 A 8/2009
(Continued)

OTHER PUBLICATIONS

Abstract of JP2004-171911, dated Jun. 17, 2004, 1 page.
(Continued)

*Primary Examiner* — Hae Moon Hyeon
(74) *Attorney, Agent, or Firm* — Barley Snyder

(57) ABSTRACT

A connector assembly that includes a first connector and a second connector. The first connector has a spring member press-fitted into a housing thereof. The second connector has a groove in a housing thereof. At the time of mating, the spring member is inserted in the groove in a mating direction to be deformed elastically in a direction intersecting the mating direction. Then, with the spring member of the first connector elastically deformed in the groove of the second connector, looseness between the housing of the first connector and the housing of the second connector is prevented.

8 Claims, 12 Drawing Sheets

(51) Int. Cl.
*H01R 13/26* (2006.01)
*H01R 13/533* (2006.01)

(52) U.S. Cl.
CPC ... *H01R 13/6275* (2013.01); *H01R 13/62927* (2013.01); *H01R 13/62955* (2013.01); *H01R 13/533* (2013.01); *H01R 2201/26* (2013.01)

(58) Field of Classification Search
USPC ..... 439/349, 350–352, 372, 157, 382–385, 439/825, 838
See application file for complete search history.

(56) References Cited

U.S. PATENT DOCUMENTS

| | | | | |
|---|---|---|---|---|
| 5,439,386 | A * | 8/1995 | Ellis | H01R 13/622 439/271 |
| 6,007,364 | A * | 12/1999 | Wu | H01R 12/7005 439/101 |
| 6,074,236 | A * | 6/2000 | Wu | H01R 13/631 439/378 |
| 6,347,955 | B1 | 2/2002 | Huang | |
| 6,540,539 | B2 * | 4/2003 | Yahiro | H01R 12/7005 439/326 |
| 7,285,005 | B2 * | 10/2007 | Gabrielsson | H01R 13/6278 439/362 |
| 7,695,302 | B2 * | 4/2010 | Eissner | H01R 13/6277 439/349 |
| 8,092,246 | B1 | 1/2012 | Santiago | |
| 8,834,193 | B2 * | 9/2014 | Li | H01R 13/6275 439/345 |
| 2005/0221647 | A1 | 10/2005 | Dillon et al. | |
| 2006/0040533 | A1 | 2/2006 | Koshy et al. | |
| 2008/0102683 | A1 | 5/2008 | Menez | |
| 2009/0325416 | A1 | 12/2009 | Shindo et al. | |
| 2017/0256889 | A1 * | 9/2017 | Yoshida | H01R 13/6275 |
| 2017/0352982 | A1 * | 12/2017 | Mito | H01R 13/62977 |

FOREIGN PATENT DOCUMENTS

| | | | |
|---|---|---|---|
| JP | 2004171911 | A | 6/2004 |
| JP | 2004-186078 | A | 7/2004 |
| JP | 2005203307 | A | 7/2005 |
| JP | 2009-230898 | A | 10/2009 |
| JP | 2010-073361 | A | 4/2010 |
| JP | 2010073364 | A | 4/2010 |
| JP | 2011023201 | A | 2/2011 |
| JP | 2011-048995 | A | 3/2011 |
| JP | 2012-015055 | A | 1/2012 |
| JP | 2012-064463 | A | 3/2012 |
| JP | 2014-059960 | A | 4/2014 |
| WO | 2006/110134 | A1 | 10/2006 |

OTHER PUBLICATIONS

Abstract of JP2011-023201, dated Feb. 3, 2011, 1 page.
Abstract of JP2009230898A, dated Oct. 8, 2009, 1 page.
Abstract of JP2010073361A, dated Apr. 2, 2010, 1 page.
Abstract of JP2012015055A, dated Jan. 19, 2012, 1 page.
Abstract of JP2014059960A, dated Apr. 3, 2014, 1 page.
Japanese Office Action, dated Apr. 13, 2018, 3 pages.
Search Report, dated Sep. 5, 2017, 8 pages.
Japanese Office Action, dated Aug. 27, 2018, 3 pages.
Abstract of JP2012064463, dated Mar. 29, 2012, 1 page.
Abstract of JP2004186078, dated Jul. 2, 2004, 1 page.
Abstract of JP2011048995, dated Mar. 10, 2011, 1 page.
Abstract of JP2010073364, dated Apr. 2, 2010, 1 page.
Abstract of JP2005203307, dated Jul. 28, 2005, 1 page.
First Chinese Office Action and English translation, Application No. 201710418756.1, dated Oct. 15, 2018, 10 pages.
European Patent Office Communication, Appl. No. 17 173 133.4, dated Nov. 30, 2018, 7 pages.

* cited by examiner

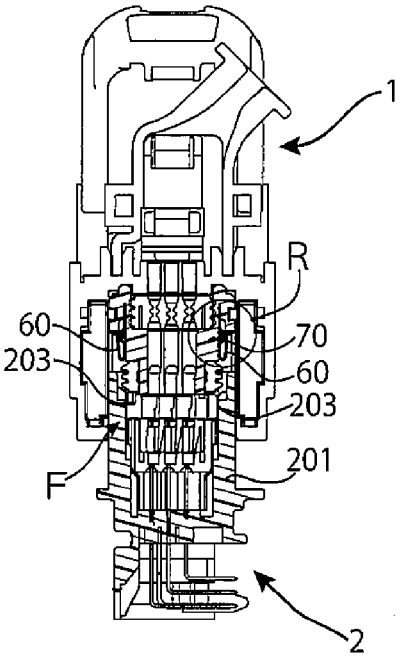
Fig. 11(A-1)
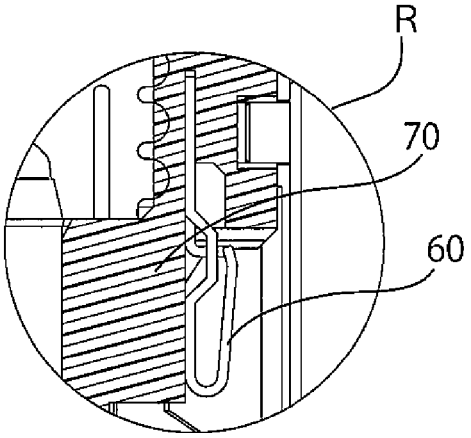
Fig. 11(B-1)
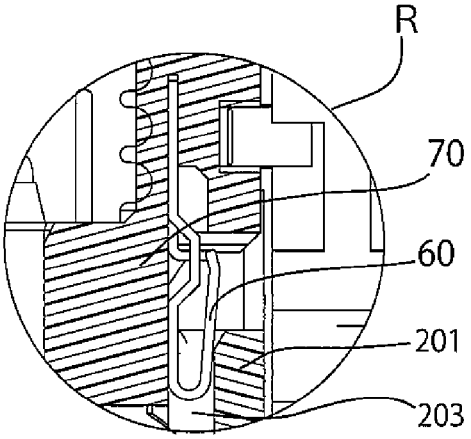
Fig. 11(B-2)
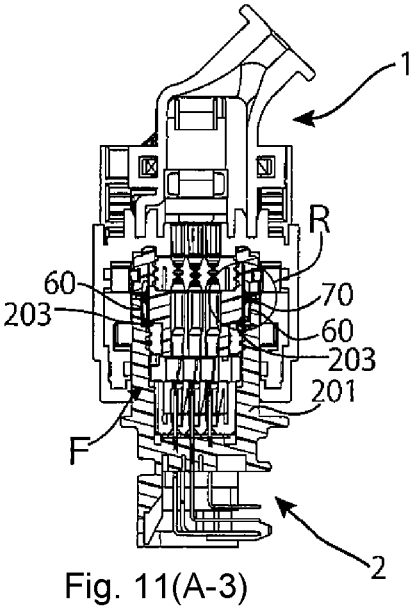
Fig. 11(A-3)
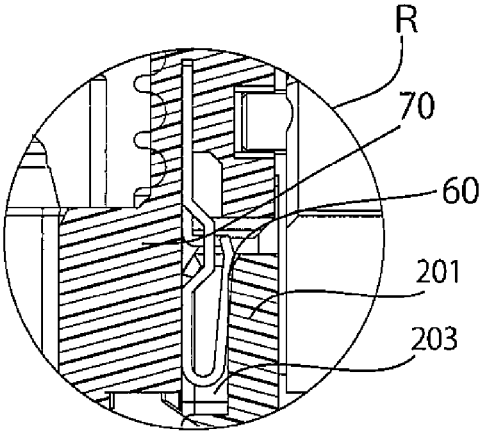
Fig. 11(B-3)

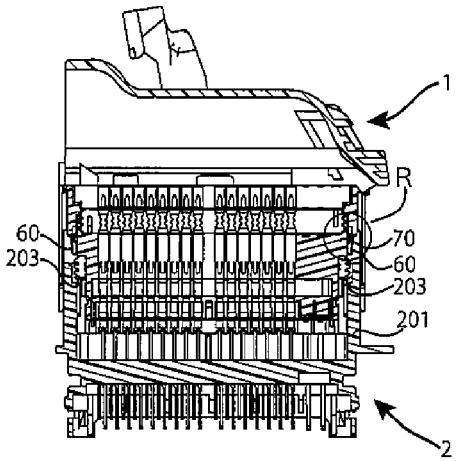
Fig. 12(A-1)
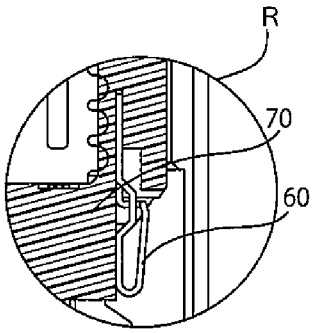
Fig. 12(B-1)
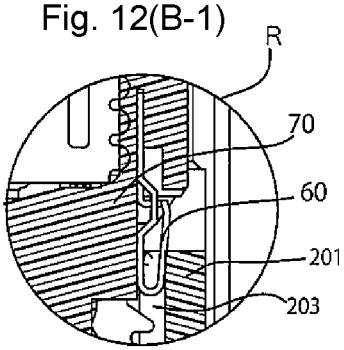
Fig. 12(B-2)
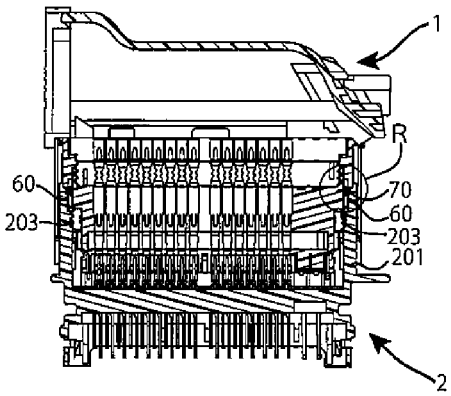
Fig. 12(A-3)
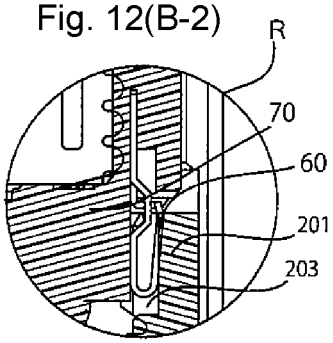
Fig. 12(B-3)

CONNECTOR AND CONNECTOR ASSEMBLY HAVING ELASTICALLY DEFORMED SPRINGS

CROSS-REFERENCE TO RELATED APPLICATIONS

This application claims the benefit of the filing date under 35 U.S.C. § 119(a)-(d) of Japanese Patent Application No. 2016-113546, filed Jun. 7, 2016.

FIELD OF THE INVENTION

The present invention relates to a connector and a connector assembly which have configurations to prevent looseness between housings.

BACKGROUND

Connectors often are positioned in locations where they are exposed to vibrations. One example is positioning a connector near the engine of an automobile. In such a case, if looseness occurs between housings, contact sections of the connectors may rub against each other and be scraped, leading to contact failures.

In Japanese Patent Publication JP 2011-23201A, a configuration is proposed in which a spring member is arranged between respective housings to prevent looseness between the housings.

However, with the configuration proposed in Japanese Patent Publication JP 2011-23201A, the spring member is sandwiched between the respective housings to press the spring member in a mating direction so as to cause the spring member to be deformed elastically. For this reason, in this configuration, a force required to cause the spring member to be deformed elastically is directly added to the force required for mating when the spring member is not provided and, thus, the mating force may become excessive. In addition, a locking mechanism, strong enough to counter a restoring force of the spring member being deformed elastically, is required.

SUMMARY

A connector, according to the present invention, includes a first housing adapted to mate with a second housing of a second connector that has a groove. This connector also has a spring member fixed to the first housing and adapted to be inserted into the groove in the second housing in a mating direction and deformed elastically in a direction intersecting the mating direction, so as to prevent looseness between the first housing and the second housing.

A connector assembly, according to the present invention, includes a first connector and a second connector. The first connector has a first housing and a plurality of elastically deformed spring members fixed to the first housing and disposed in a direction intersecting the mating direction when the first connector is mated with a second connector. The second connector is mated with the first connector and includes a second housing having two grooves in which the elastically deformed spring members are inserted.

BRIEF DESCRIPTION OF THE DRAWINGS

FIGS. 11(A-1) and 11(A-3) are cross-sectional views of the connector assembly taken along line E-E of FIG. 9(A) and FIGS. 11(B-1), 11(B-2), and 11(B-3) are cross-sectional views, on an enlarged scale, of the circled portions of the cross-sectional views taken along line E-E of FIG. 9(A); and FIGS. 12(A-1) and 12(A-3) are cross-sectional views of the connector assembly taken along line C-C in FIG. 9(A) and FIGS. 12(B-1), 12(B-2), and 12(B-3) are cross-sectional views, on an enlarged scale, of the circled portions of the cross-sectional views taken along line C-C in FIG. 9(A).

DETAILED DESCRIPTION OF THE EMBODIMENT(S)

Figure 1:
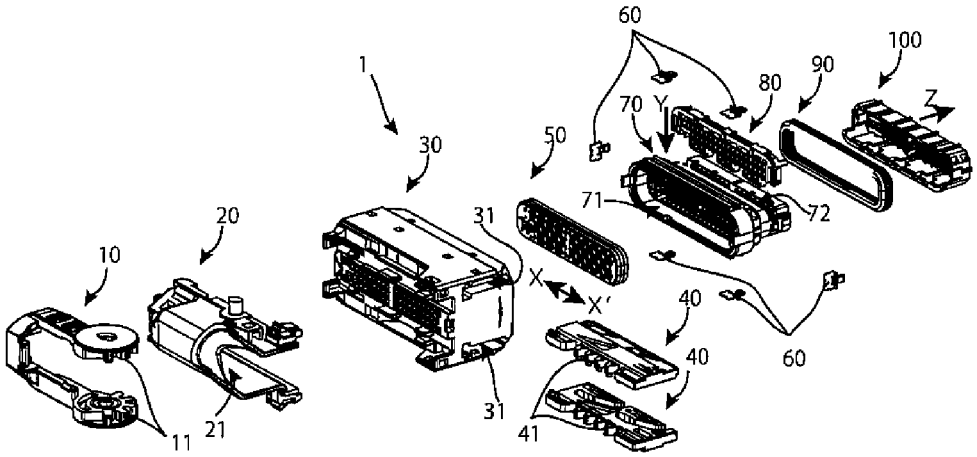
FIG. 1 is an exploded perspective view of a first embodiment of a connector constructed in accordance with the present invention.
Figure 9A:
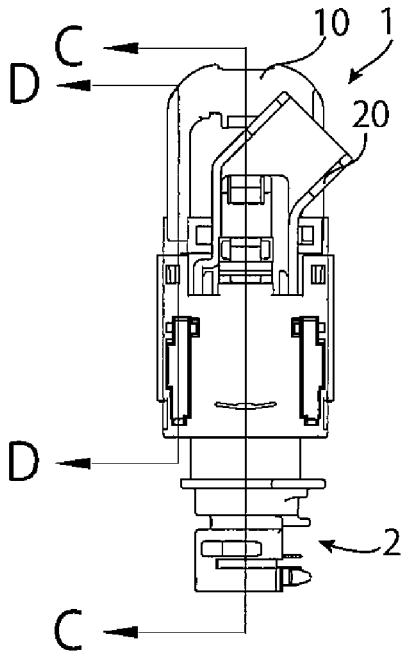
FIGS. 9(A) and 9(B) are, respectively, a side view and a sectional view taken along line C-C in FIG. 9(A) of a connector assembly including the first connector and a second connector.
Figure 9B:
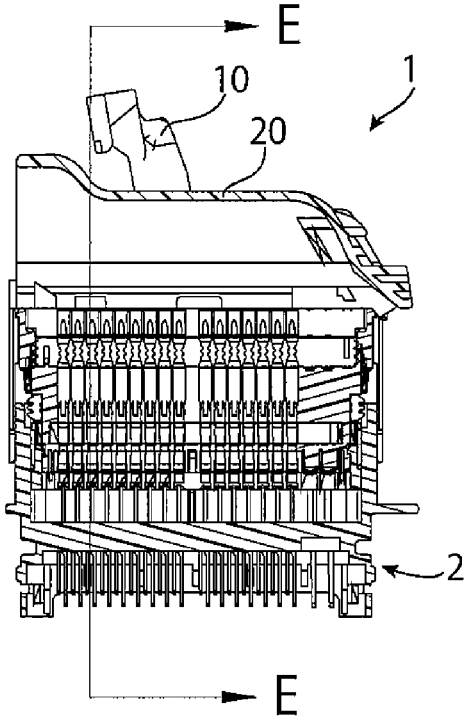

Referring to FIGS. 1, 9(A), and 9(B), the connector illustrated in the exploded perspective view in FIG. 1 is referred to as a first connector 1 and a mating connector to mate with the first connector is referred to as a second connector 2 in FIGS. 9(A) and 9(B). A connector assembly, as an embodiment of the present invention, is formed with the first connector 1 and second connector 2.

A large number of terminals which are connected to one of the ends of electrical wires are inserted into the connector 1. These electrical wires and the like are not shown.

In addition, the connector 1 illustrated in FIG. 1 includes an operation lever 10. The operation lever 10 has pinon gears 11. The operation lever 10 causes cam members 40, which will be described in detail below, to slide by a rotating operation of an operator.

The first connector 1 also includes a wire cover 20. This wire cover 20 includes an opening 21 through which the not-illustrated large number of wires connected at one of the ends of the terminals pass.

In addition, the first connector 1 includes a housing having an outer housing 30, an inner housing 70, and a front housing 100. This particular housing is an example of the first housing constructed in accordance with the present invention.

The outer housing 30 has two grooves communicating with openings which open in side walls thereof and the two cam members 40 having plate shapes are inserted into the grooves, respectively. These cam members 40 are provided with racks 41. The racks 41 engage with the pinion gears 11 of the operation lever 10 and the cam members 40 are slid in a lateral direction indicated with Arrows X-X' in FIG. 1 by the rotating operation of the operation lever 10.

The first connector 1 includes two seal members 50, 90. One seal member 50 is inside an opening 71 of the inner housing 70. Seal member 50 closely contacts a surrounding wall of the opening 71 and also surrounds the not-illustrated electrical wires to closely contact the respective electrical wires, serving to form a seal between them.

The other seal member 90 surrounds an outer circumference of the inner housing 70 and serves to form a seal between the inner housing 70 and the second connector 2 being mated therewith, as shown in FIGS. 9(A) and 9(B), FIGS. 11(A-1), 11(A-3), 11(B-1), 11(B-2), and 11(B-3), and FIGS. 12(A-1), 12(A-3), 12(B-1), 12(B-2), and 12(B-3).

The first connector 1 includes a retainer 80. This retainer 80 is inserted in a direction of Arrows Y into a groove 72 which opens in a lateral direction of the inner housing 70. Retainer 80 serves to securely position and fix the not-illustrated terminals in the inner housing 70.

The first connector 1 includes six spring members 60. Tail sections of those spring members 60 are press-fitted into the inner housing 70 and the spring members 60 protrude in a mating direction indicated by Arrow Z. A mating section of the first connector 1, which mating section includes the inner housing 70, has an approximately rectangular shape when being projected in the mating direction, namely in the direction of Arrow Z. Two pieces of the six spring members 60 are press-fitted into two short sides of the approximately rectangular shape, one piece each. The remaining four pieces of the six spring members 60 are press-fitted into two long sides of the approximately rectangular shape, two pieces each. The spring members 60, which are press-fitted into the long sides, two pieces each, are press-fitted into positions each near each of the short sides on both sides across each of the long sides, one piece each, respectively. Operations of these spring members 60 will be explained below.

Figure 2:
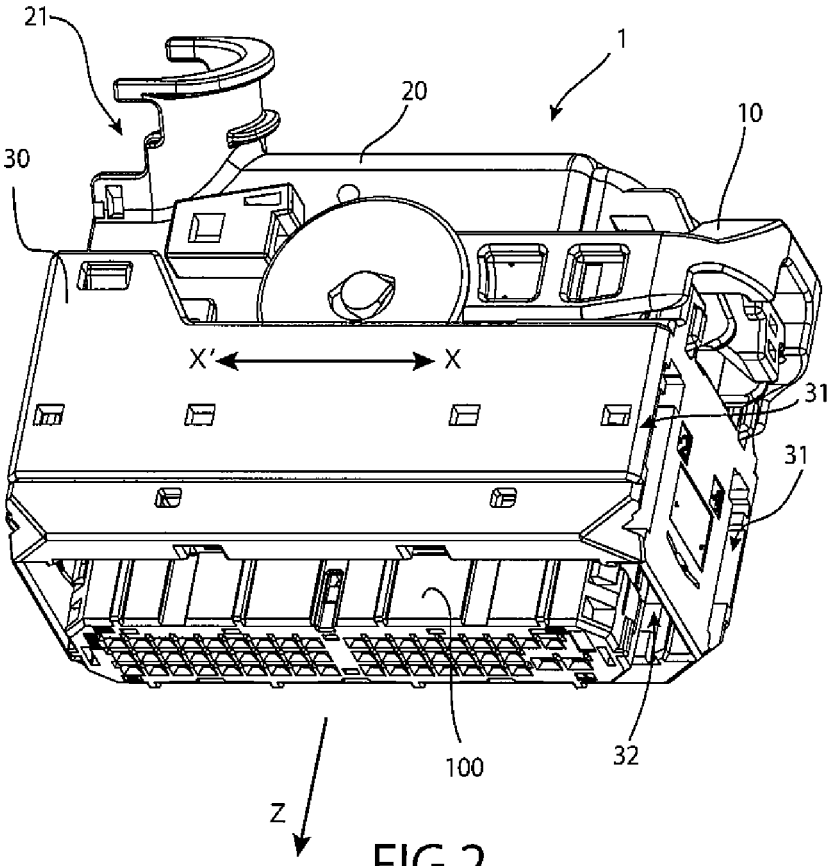
FIG. 2 is a perspective view of the FIG. 1 connector after is has been assembled.

FIG. 2 is a perspective view of the FIG. 1 first connector after it has been assembled.

Outer housing 30 has a mating opening 32 which opens in the mating direction (the direction indicated by Arrow Z). The inner housing 70 (see FIG. 1) and the front housing 100 are in the mating opening 32. The front housing 100 forms a circumferential space for mating with the second connector between the outer housing 30 and the front housing 100 and protrudes from the mating opening 32.

Although the second connector 2 is not illustrated in FIG. 2, the operation lever 10 is rotated to a state of complete mating of the second connector 2 to be in posture of being fallen. When the operation lever 10 is in the posture illustrated in FIG. 2, the cam members 40 are in a state of being completely inserted into the grooves communicating with the opening 31.

Figure 3:
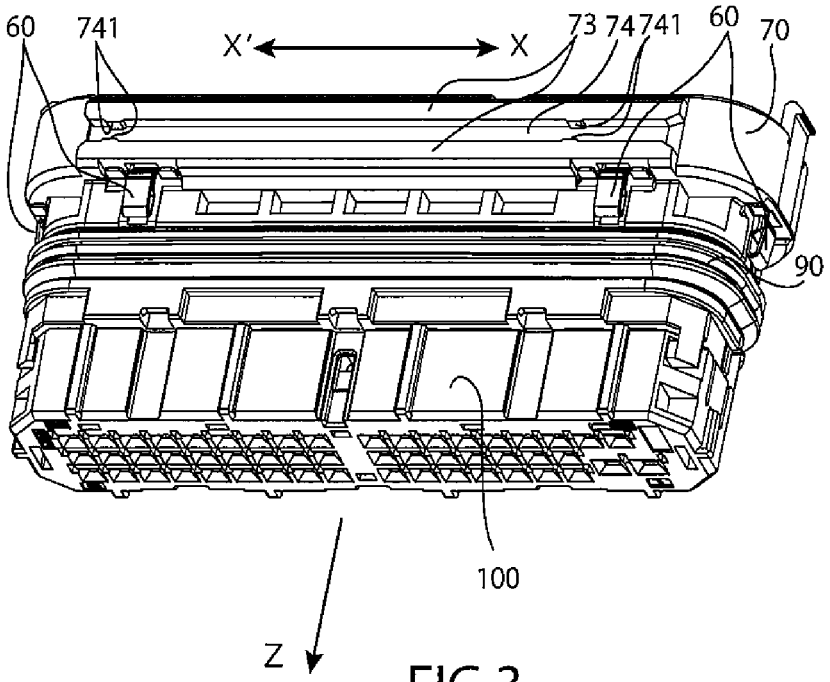
FIG. 3 is a perspective view of the FIG. 2 connector with the wire cover, the operation lever, and the outer housing removed from the connector.

FIG. 3 is a perspective view illustrating an assembly in which the wire cover, the operation lever, and the outer housing are removed from the first connector in the assembled state illustrated in FIG. 2.

The inner housing 70, the seal member 90, the front housing 100, and the spring members 60 are shown in FIG. 3. The spring members 60 are press-fitted into the inner housing 70 and protrude from the inner housing 70 in the mating direction (the direction of Arrow Z). As illustrated, spring members 60 are press-fitted into left and right short sides, one piece each, and two spring members 60 are press-fitted into the positions of one of the long sides, each of which positions is near each of the short sides. Two spring members 60 are similarly press-fitted into the long side opposite to the long side illustrated in FIG. 3.

A long groove 74, sandwiched by two rails 73 extending along the long side, is formed in the inner housing 70. Not shown in FIG. 3 are two rails 73 and a long groove 74 is formed similarly in a long side on the opposite side. Bosses 42 of the cam member 40, shown in FIG. 4, enter the long groove 74. The cam member 40 is slid in the lateral direction indicated by Arrows X-X' while being guided by the long groove 74 in a state in which the bosses 42 enter the long groove 74. In the long groove 74, a narrowed section 741 in which a groove width is narrowed, is formed at each of two locations. Operations of the narrowed sections 741 will be described below.

Figure 4A:
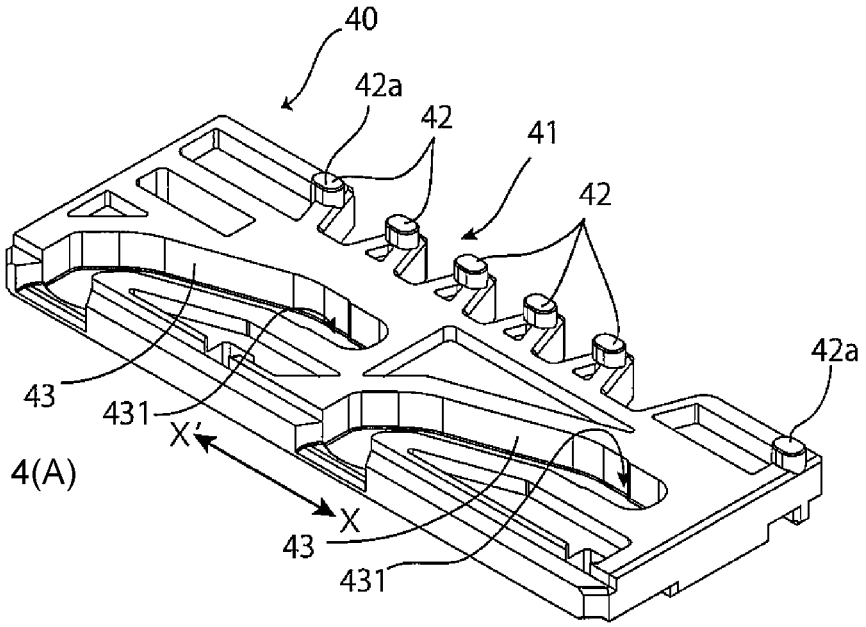
FIGS. 4(A) and 4(B) are, respectively, a perspective view and a plan view of the cam member of a connector constructed in accordance with the present invention.
Figure 4B:
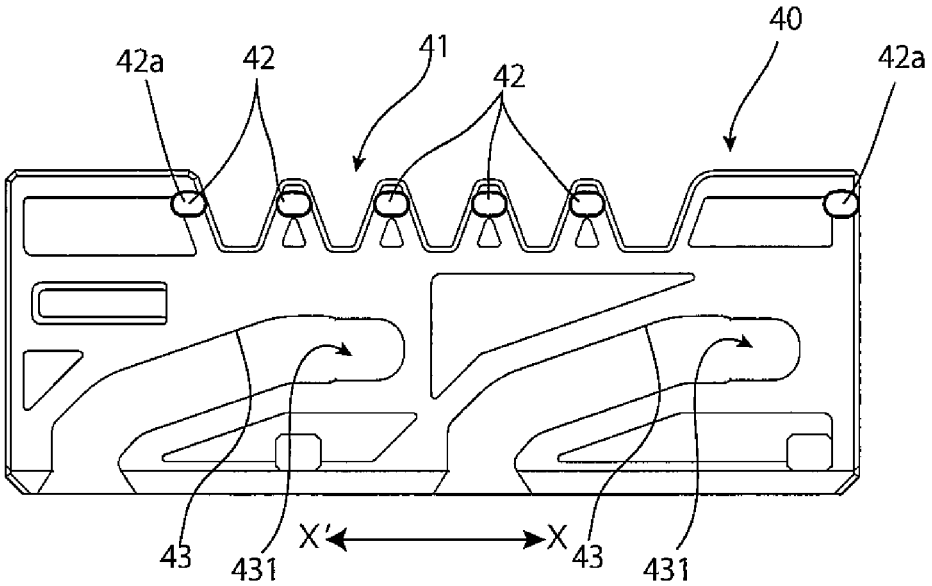

FIGS. 4(A) and 4(B) are, respectively, a perspective view and a plan view of a cam member.

The two cam members 40 are in the first connector 1 as illustrated in FIG. 1. The cam member 40, illustrated in FIGS. 4(A) and 4(B), is one cam member 40 of the two cam members 40. The other cam member 40 is a mirror image with respect to the cam member 40 illustrated in FIGS. 4(A) and 4(B).

Cam member 40 has a rack 41. Rack 41 engages with the pinion gear 11 of the operation lever 10 as illustrated in FIG. 1 to cause the cam member 40 to slide in the lateral direction (the direction of Arrows X-X') according to the rotating operation of the operation lever 10.

Cam member 40 has six bosses 42 that are aligned laterally. The bosses 42 enter the long groove 74 illustrated in FIG. 3. Cam member 40 is slid while being guided by the long groove 74. The cam member 40 serves in drawing in the second connector 2 toward complete mating in such a manner as explained in the following. The cam member 40 receives a force from the second connector 2 when drawing in the second connector 2. Bosses 42 are formed by six pieces in this cam member 40 and provide enough strength to catch the force to be received from the mating second connector 2.

Two cam grooves 43 are formed in cam member 40. Mating protrusions 202 (see FIGS. 10(A), 10(B), and 10(C)) on a housing 201 (see FIGS. 11 and 12) of the second connector 2 to mate with the first connector 1 enter these cam grooves 43. Each of the mating protrusions 202 corresponds to the cam pin according to the present invention.

When the cam member 40 is slid by the rotating operation of the operation lever 10, the mating protrusions 202 are drawn into the cam grooves 43. Thus, the second connector 2 is drawn into the first connector 1 toward the complete mating state. When the mating protrusions 202 are drawn into the deepest positions in the cam grooves 43, mating of the first connector 1 and the second connector 2 is completed. In other words, the first connector 1 and the second connector 2 reach a state of completely mating with each other.

In the cam grooves 43 in the cam member 40, there are narrowed sections 431 in each of which the groove width is narrowed in the deepest portions thereof. Operations of the narrowed sections 431 will be described below.

Figure 5A:
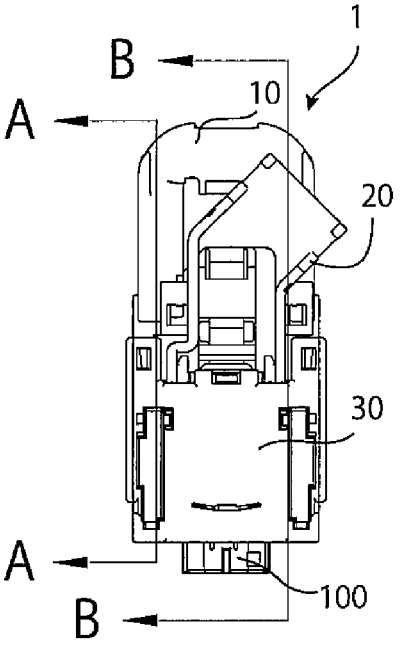
FIGS. 5(A) and 5(B) are, respectively, a side view and a plan view of a connector constructed in accordance with the present invention.
Figure 5B:
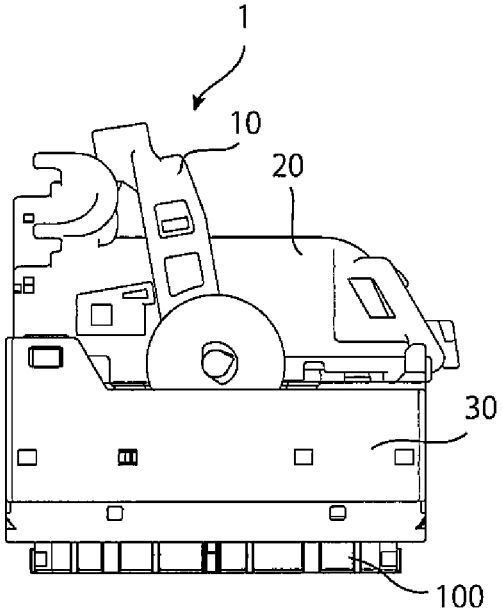

FIGS. 5(A) and 5(B) are, respectively, a side view and a plan view of the first connector.

In FIGS. 5(A) and 5(B), the operation lever 10 is in a posture of standing up. A state of the first connector 1, when the operation lever 10 is in the posture of standing up, is referred to as "a mating starting state." On the other hand, a state of the first connector 1, when the operation lever 10 is in the posture of being fallen as illustrated in FIG. 2, is referred to as "a complete mating state." A state of the connector 1, when the operation lever 10 is operated and rotated halfway from the position of standing up as illustrated in FIGS. 5(A) and 5(B) toward the position of being fallen as illustrated in FIG. 2, is referred to as "a halfway mating state."

Figure 6A:
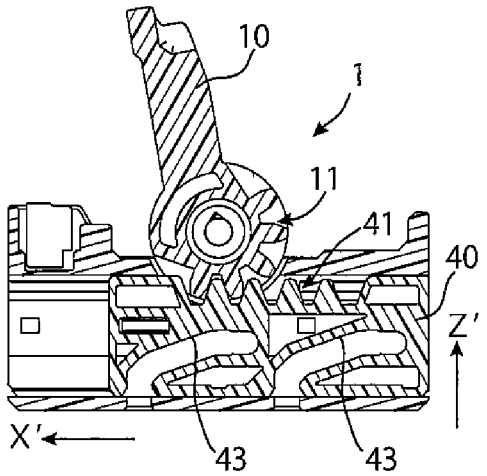
FIGS. 6(A), 6(B), and 6(C) are sectional views taken along line A-A in FIG. 5(A) with the first connector in different states.
Figure 6B:
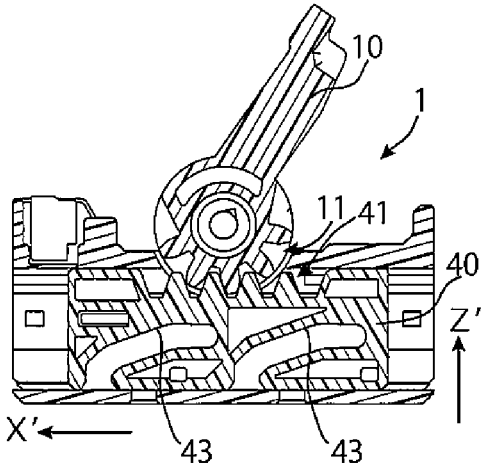
Figure 6C:
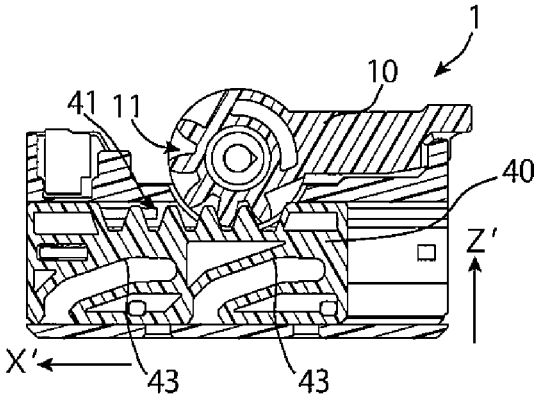

FIGS. 5(A) and 5(B) show the first connector 1 in "the mating starting state." In FIG. 6(A), the first connector is shown in "the mating starting state." In FIG. 6(B), the first connector is shown in "the halfway mating state." In FIG. 6(C), the first connector is shown in "the complete mating state" in (C). The same applies to FIGS. 7(A), 7(B), and 7(C) and FIGS. 10(A), 10(B), and 10(C) and will be described below.

As illustrated in FIGS. 6(A), 6(B), and 6(C), the pinion gear 11 of the operation lever 10 continuously engages the rack 41 of the cam member 40. The cam member 40 is slid laterally (in the direction of arrow X') as the state proceeds from "the mating starting state" illustrated in FIG. 6(A) to "the halfway mating state" illustrated FIG. 6(B), and further to "the complete mating state" illustrated in FIG. 6(C).

When the cam member 40 is in "the mating starting state" illustrated in FIG. 6(A), the cam member 40 is at a position to receive the mating protrusions 202 of the second connector 2. The cam member 40 draws in the mating protrusions 202 in the direction of Arrow Z' as the state proceeds to "the halfway mating state" and further to "the complete mating state".

Figure 7A:
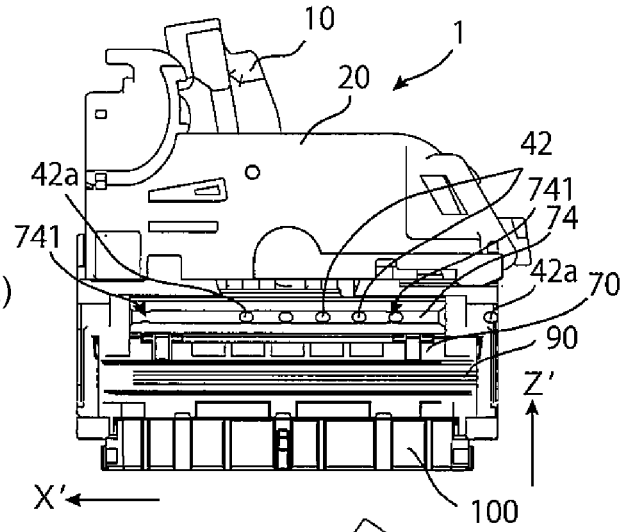
FIGS. 7(A), 7(B), and 7(C) are sectional views taken along line B-B in FIG. 5(A) with the first connector in different states.
Figure 7B:
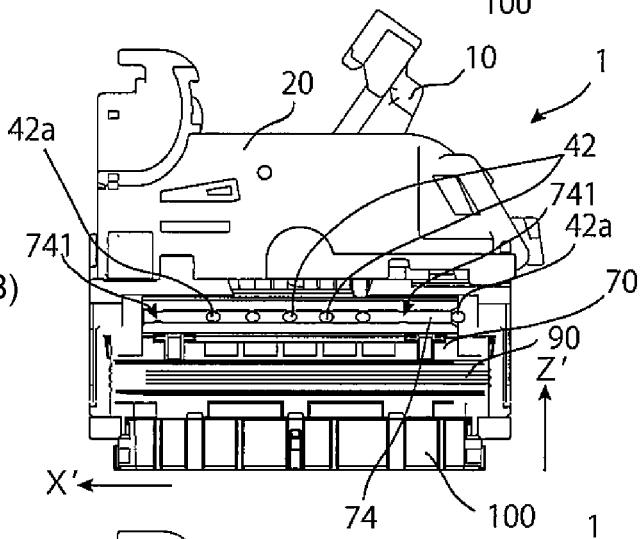
Figure 7C:
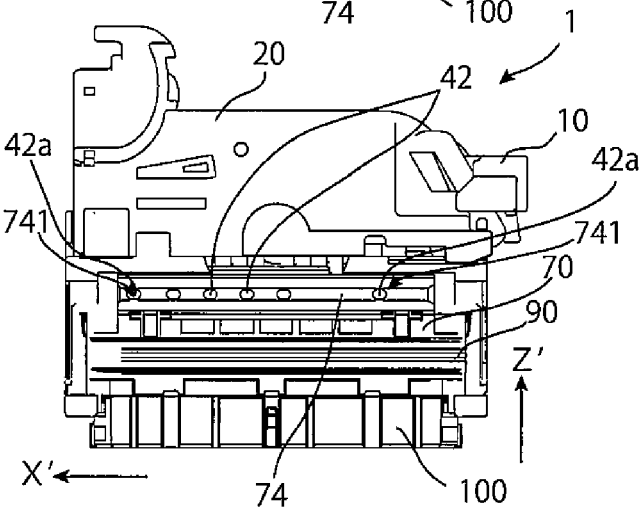

FIGS. 7(A), 7(B), and 7(C) are sectional views taken along line B-B in FIG. 5 of the first connector. Similar to FIGS. 6(A), 6(B), and 6(C), FIGS. 7(A), 7(B), and 7(C) illustrate "the mating starting state", "the halfway mating state", and "the complete mating state", respectively.

The six bosses 42 on the cam member 40 are illustrated in FIGS. 7(A), 7(B), and 7(C). These six bosses 42 move in the direction of Arrow X' as the state proceeds from "the mating starting state" to "the halfway mating state" and further to "the complete mating state." In "the complete mating state" illustrated in FIG. 7(C), two bosses 42*a* of both ends of the six bosses 42 reach a state of being caught by the narrowed sections 741 of the long groove 74 in the inner housing 70.

Figure 8A:
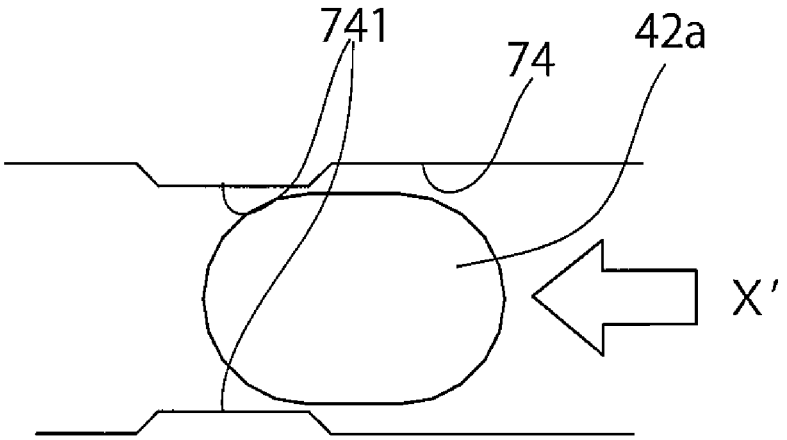
FIGS. 8(A) and 8(B) are schematic diagrams of states in which a boss of the cam member is caught by a narrowed section.
Figure 8B:
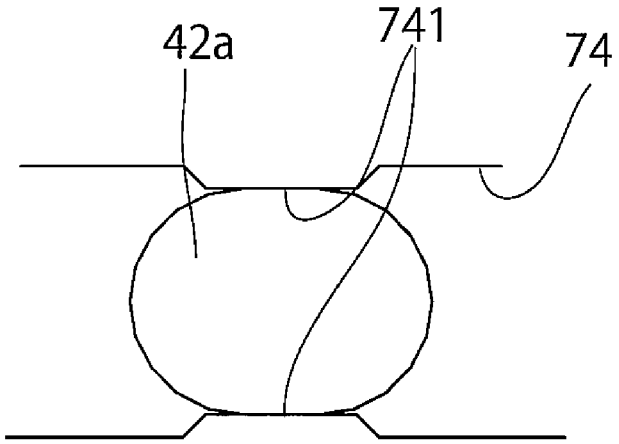

FIGS. 8(A) and 8(B) are schematic diagrams illustrating states in which the boss of the cam member is caught by the narrowed section 741 of the groove. A state in which the boss 42*a* is at a position immediately before being caught by the narrowed section 741 is illustrated in FIG. 8(A). A state in which the boss 42*a* is caught by the narrowed section 741 is illustrated in FIG. 8(B).

The cam member 40 is slid in the direction of Arrow X' to "the complete mating state." Then, as illustrated in FIG. 8B), the two bosses 42*a* of both ends of the six bosses 42 on the cam member 40 reach the state of being caught by the narrowed sections 741 of the long groove 74 in the inner housing 70. The groove widths of the narrowed sections 741 are selected so that the bosses 42*s* are lightly press-fitted. When the bosses 42*a* are press-fitted into the narrowed sections 741, the cam members 40 are united with the inner housing 70 and a state in which looseness between them is prevented.

FIGS. 9(A) and 9(B) are, respectively, a side view and a sectional view taken along line C-C in FIG. 9(A) of a connector assembly including the first connector and a second connector. In FIGS. 9(A) and 9(B), the first connector 1 is in "the mating starting state" as it is in FIGS. 5(A) and 5(B) and the first connector 1 and the second connector 2 are in a temporary mating state.

Figure 10A:
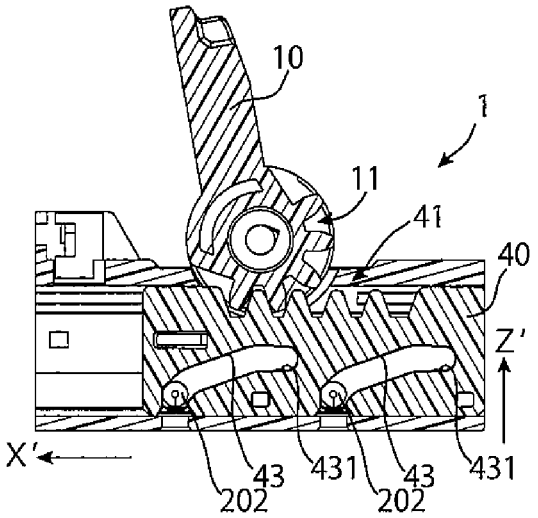
FIGS. 10(A), 10B, and 10C) are sectional views taken along line D-D in FIG. 9(A) with the connector assembly in different states.
Figure 10B:
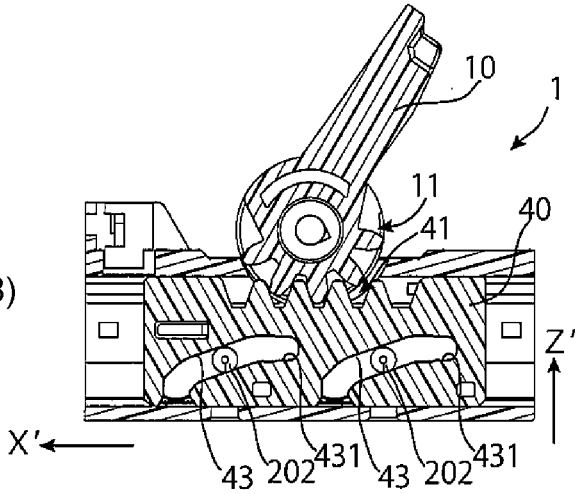
Figure 10C:
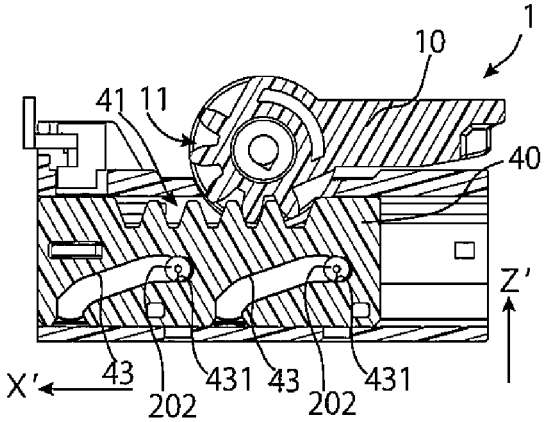

FIGS. 10(A), 10(B), and 10(C) are sectional views taken along line D-D in FIG. 9(A). FIGS. 10(A), 10(B), and 10(C) are sectional views of "the mating starting state", "the halfway mating state", and "the complete mating state", respectively.

The mating protrusions 202 on the housing 201 are illustrated in FIGS. 10(A), 10(B), and 10C.

With the first connector 1 in "the mating starting state" illustrated in FIG. 10(A), the second connector 2 is inserted into the first connector 1 to a temporary mating state. Then, as illustrated in FIG. 10(A), the mating protrusions 202 of the second connector 2 enter entrance sections of the cam grooves 43 of the cam member 40. Subsequently, starting with the operation lever standing up, the operation lever proceeds to "the halfway mating state" of FIG. 10(B) and further to "the complete mating state" of FIG. 10(C). At this moment, the cam member 40 is slid in the direction of Arrow X' to draw in the mating protrusions 202 in the direction of Arrow Z'. When the mating protrusions 202 are drawn in to the deepest positions of the cam grooves 43 illustrated in FIG. 10(C), the second connector 2 reaches the state of completely mating with the connector 1.

The cam grooves 43 include the narrowed sections 431 in which the widths of the grooves 43 are narrowed at the locations where the mating protrusions 202 are positioned in "the complete mating state." The groove widths in the narrowed sections 431 are such that the mating protrusions 202 are lightly press-fitted into the narrowed sections 431. Accordingly, in "the complete mating state" illustrated in FIG. 10(C), the housing 201 of the second connector 2 is united with cam member 40 and the state of looseness between them is prevented. In "the complete mating state", as explained with reference to FIGS. 6(A), 6(B), and ^(C) and FIGS. 7(A), 7(B), and 7(C), the bosses 42*a* of the both ends of the cam member 40 are caught by the narrowed sections 741 of the long groove 74 of the inner housing 70 of the first connector 1. As described, in "the complete mating state", with the mating protrusions 202 being caught by the narrowed sections 431 and the bosses 42*a* being caught by the narrowed sections 741, the first connector 1 and the second connector 2 are united with each other via the cam members 40 and thus looseness between them is prevented. The looseness prevention, achieved via the cam members 40, is specifically effective for looseness prevention in the mating direction (the direction of Arrow Z' or the direction of Arrow Z illustrated in FIG. 1).

FIGS. 11(A-1) and 11(A-3) are cross-sectional views of the connector assembly taken along line E-E of FIG. 9(A) and FIGS. 11(B-1), 11(B-2), and 11(B-3) are cross-sectional views, on an enlarged scale, of portions of the cross-sectional views taken along line E-E of FIG. 9(A). FIGS. 11(A-1) and (A-3) are sectional views of "the mating starting state" and "the complete mating state", respectively. A sectional view in "the halfway mating state" is not illustrated.

FIGS. 11(B-1) and 11(B-3) are enlarged views of portions identified by circles R in FIGS. 11(A-1) and 11(A-3), respectively. In addition, FIG. 11(B-2) is an enlarged view of a corresponding portion in "the halfway mating state."

Spring members 60 are illustrated in FIGS. 11(A-1) and 11(A-3) and FIGS. 11(B-1), 11(B-2), and 11(B-3). The spring members 60 illustrated in FIGS. 11(A-1) and 11(A-3) and FIGS. 11(B-1), 11(B-2), and 11(B-3) are the spring members 60 arranged on the long sides of the mating section which forms the approximately rectangular shape when being projected in the mating direction. These spring members 60 are firmly press-fitted into the inner housing 70. Spring members 60 are exposed from the inner housing 70 and protrude toward the second connector 2. On the other hand, grooves 203, which allow the spring members 60 to enter the grooves 203, are in the housing 201 of the second connector 2. The spring members 60 are inserted into the grooves 203 of the housing 201 in the second connector 2 being mated therewith in the mating direction. Then, when the spring members 60 are inserted into the grooves 203, the spring members 60 are elastically deformed in a direction intersecting the mating direction (a horizontal direction of the FIGS. 11(A-1) and 11(A-3) and FIGS. 11(B-1), 11(B-2), and 11(B-3). The spring members 60 are shown in a state before being elastically deformed. For this reason, the spring member 60 is shown in a state in which the spring member 60 bites into a wall surface of the groove 203. In fact, the spring member 60 is press-fitted by the wall surface of the groove 203 to be elastically deformed.

FIGS. 12(A-1) and 12(A-3) are cross-sectional views of the connector assembly taken along line C-C in FIG. 9(A) and FIGS. 12(B-1), 12(B-2), and 12(B-3) are cross-sectional views, on an enlarged scale, of the circled portions of the cross-sectional views taken along line C-C in FIG. 9(A).

Similar to FIGS. 11(A-1) and 11(A-3), FIGS. 12(A-1) and 12(A-3) are sectional views of "the mating starting state" and "the complete mating state", respectively. A sectional view in "the halfway mating state" is not illustrated.

FIGS. 12(B-1) and 12(B-3) are enlarged views of portions identified by circles R in FIGS. 12(A-1) and 12(A-3), respectively. In addition, FIG. 12(B-2) is an enlarged view of a corresponding portion in "the halfway mating state."

Spring members 60 are shown in FIGS. 12(A-1) and 12(A-3) and in FIGS. 12(B-1), 12(B-2), and 12(B-3). The spring members 60 illustrated in FIGS. 12(A-1) and 12(A-3) and in FIGS. 12(B-1), 12(B-2), and 12(B-3) are the spring members 60 arranged on the short sides of the mating section which forms the approximately rectangular shape when being projected in the mating direction. These spring members 60 are firmly press-fitted into the inner housing 70. The spring members 60 are exposed from the inner housing 70 and protrude toward the second connector 2. On the other hand, the grooves 203 which allow the spring members 60 to enter the grooves 203 are provided in the housing 201 of the second connector 2. The spring members 60 are inserted into the grooves 203 of the housing 201 in the second connector 2 being mated therewith in the mating direction. Then, when the spring members 60 are inserted into the grooves 203, the spring members 60 are elastically deformed in a direction intersecting the mating direction. The spring members 60 are illustrated while maintaining a state before being elastically deformed. For this reason, in FIGS. 12(B-2) and 12(B-3), the spring member 60 is illustrated in a state in which the spring member 60 bites into the wall surface of the groove 203. In fact, the spring member 60 is press-fitted by the wall surface of the groove 203 to be elastically deformed.

There are six spring members 60 illustrated in FIG. 1. These spring members 60 are press-fitted into the inner housing 70 of the first connector 1. The spring members 60 enter the grooves 203 of the housing 201 of the second connector 2 in the state of being elastically deformed at the time of mating. For this embodiment of the present invention, looseness between the first connector 1 and the second connector 2 is prevented by the spring members 60 and the grooves 203. The looseness prevention due to the spring members 60 and the grooves 203 is effective mainly for preventing looseness in a direction on a plane intersecting the mating direction.

Six spring members 60 are provided in the present embodiment. However, the number of the spring members 60 is not limited to six and the number of spring members 60 included is dependent on how many are required to effectively prevent looseness.

In addition, the spring members 60 are provided on each of the long sides and the short sides of the mating section in the present embodiment of the invention. However, in a case in which a direction of vibration is limited, the spring members 60 may be provided, for example, only on the short sides or only on the long sides for preventing looseness in a direction according to the direction of vibration.

Furthermore, in the present embodiment of the invention, the spring members 60 are arranged behind the seal member 90 along the mating direction Z, However, the spring members 60 may be arranged at a position ahead of the seal member 90, such as a position of F in FIGS. 11(A-1) and 11(A-3).

What is claimed is:

1. A connector comprising:

a first housing having, a mating section to mate with a second housing which is a housing of a second connector, and an inner housing positioned on an interior of the first housing having an approximately rectangular shape when being projected in a mating direction wherein the inner housing has a spring member fixed to a side face of the inner housing; and the spring member is inserted into a groove provided in the second housing being mated therewith in the mating direction to be deformed elastically in a direction intersecting the mating direction so as to prevent looseness between the first housing and the second housing.

2. The connector according to claim 1, further comprising:

a groove in the first housing, and a cam member, wherein the cam member is inserted into the groove and, the cam member having a rack receives a cam pin provided in the second housing to be slid in a direction intersecting the mating direction and draw in the cam pin so as to cause the second housing to be mated; and an operation lever having a pinion gear that engages the rack that causes the cam member to slide by a rotating operation.

3. The connector according claim 2, wherein the mating section has an approximately rectangular shape when being projected in the mating direction, and the spring member is provided on each of a short side and a long side of the approximately rectangular shape of the mating section.

4. A connector assembly comprising:

a first connector including a first housing and a second connector including a second housing which mate with each other, wherein the first connector includes an inner housing positioned on an interior of the first housing having an approximately rectangular shape when being projected in a mating direction wherein the inner housing has a spring member fixed to a side face of the inner housing; and the second connector includes a groove which is formed in the second housing, into which the spring member is inserted in the mating direction at the time of mating to be deformed elastically in a direction intersecting the mating direction so as to prevent looseness between the first housing and the second housing via the spring member.

5. A connector comprising:

a first housing:

(a) adapted to mate with a second housing of a second connector, and (b) having a mating section having an approximately rectangular shape when being projected in a mating direction; and a plurality of spring members:

(a) with one spring member fixed to each of a short side and a long side of the approximately rectangular shape of the mating section, and (b) adapted to be inserted into a groove in the second housing in the mating direction and deformed elastically in a direction intersecting the mating direction, so as to prevent looseness between the first housing and the second housing.

6. A connector assembly comprising:

a first connector including:

(a) a first housing, and (b) an inner housing positioned on an interior of the first housing having an approximately rectangular shape when being projected in a mating direction wherein the inner housing has a plurality of side faces, and (c) a plurality of elastically deformed spring members fixed to the side faces of the inner housing and disposed in a direction intersecting the mating direction when the first connector is mated with a second connector; and the second connector mated with the first connector and including a second housing having two grooves in which the elastically deformed spring members are inserted.

7. The connector assembly according to claim 6, wherein:

(a) the first housing has a mating section having an approximately rectangular shape when being projected in the mating direction, and (b) one spring member is fixed to each of a short side and a long side of the approximately rectangular shape of the mating section.

8. The connector assembly according to claim 7, wherein:

(a) the first connector further includes an outer housing positioned on an exterior of the first connector having a groove and a cam member wherein the cam member is inserted into the groove, and (b) the second connector further includes a cam pin wherein the cam pin is on the second connector and received by the cam member, and (c) an operation lever on the first connector that causes the cam member to slide to mate the first connector and the second connector.

* * * * *